US008936487B2

(12) United States Patent
Takane et al.

(10) Patent No.: US 8,936,487 B2
(45) Date of Patent: Jan. 20, 2015

(54) CONNECTOR WITH PRESSING PLATE

(75) Inventors: Toru Takane, Kanagawa (JP); Kenichi Yamaguchi, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 13/825,465

(22) PCT Filed: May 31, 2012

(86) PCT No.: PCT/JP2012/064055
§ 371 (c)(1),
(2), (4) Date: Mar. 21, 2013

(87) PCT Pub. No.: WO2012/172984
PCT Pub. Date: Dec. 20, 2012

(65) Prior Publication Data

US 2014/0099828 A1 Apr. 10, 2014

(30) Foreign Application Priority Data

Jun. 13, 2011 (JP) ..... 2011-131384

(51) Int. Cl.

| | |
|---|---|
| ***H01R 24/00*** | (2011.01) |
| ***H01R 13/46*** | (2006.01) |
| ***H01R 12/79*** | (2011.01) |
| ***H01R 12/88*** | (2011.01) |

(52) U.S. Cl.
CPC ..... *H01R 13/46* (2013.01); *H01R 12/79* (2013.01); *H01R 12/88* (2013.01)
USPC ..... 439/626

(58) Field of Classification Search
CPC ..... H01R 13/46; H01R 12/79; H01R 12/88
USPC ..... 439/626, 492, 493, 494, 495, 260, 267
See application file for complete search history.

(56) References Cited

U.S. PATENT DOCUMENTS 7,387,528 B2 * 6/2008 Lee et al. ..... 439/495

FOREIGN PATENT DOCUMENTS

| | | |
|---|---|---|
| JP | 08050968 | 2/1996 |
| JP | 2892945 A | 2/1999 |
| JP | 2001-338712 | 7/2001 |

(Continued)

OTHER PUBLICATIONS

International Search Report From Cooresponding Application No. PCT/2010/066923.

*Primary Examiner* — Javaid Nasri
(74) *Attorney, Agent, or Firm* — Lowe Hauptman & Ham, LLP

(57) ABSTRACT

A connector which, when two contacts contact a connection object at positions different from each other in the insertion/extraction direction of the connection object, suppresses deflection of the connection object without increasing a pressing member size. The connector configured so, when the pressing member is rotated to a closed position, a pressing plate is brought into surface contact with the other thickness direction surface of a flexible circuit while pressed by a pressing member pressing portion, and a range including the contact positions between the flexible circuit and first and second contacts is pressed from the side of the other thickness direction surface of the flexible circuit via the pressing plate, so one thickness direction surface of the flexible circuit is brought into press-contact with the first and second contacts. Deflection of the flexible circuit is suppressed by the pressing plate, and the pressing member size need not be increased.

6 Claims, 5 Drawing Sheets

(56) References Cited

FOREIGN PATENT DOCUMENTS

| | | |
|---|---|---|
| JP | 2006-120429 | 5/2006 |
| JP | 2007-265911 | 10/2007 |
| JP | 2007-280785 | 10/2007 |
| JP | 4372224 | 9/2009 |
| JP | 4568791 A | 8/2010 |
| WO | 2011/040448 | 9/2010 |

* cited by examiner

CONNECTOR WITH PRESSING PLATE

TECHNICAL FIELD

The present invention relates to a connector for connecting, for example, a flexible printed circuit (FPC) and a flexible flat cable (FFC).

BACKGROUND ART

Conventionally, as this kind of connector, there has been known a connector including a connector main body into which a flexible plate-like connection object (hereinafter referred to as flexible circuit), such as an FPC and an FFC, can be inserted, a terminal having a contact which is brought into contact with one thickness direction surface of the flexible circuit, and a rotatable pressing member which brings the flexible circuit into press-contact with the contact (see, for example, Patent Literature 1).

This connector is configured such that, when the pressing member is rotated in one direction in the state where the flexible circuit is inserted into the connector main body, the pressing member presses the other thickness direction surface of the flexible circuit, so as to bring the one thickness direction surface of the flexible circuit into press-contact with the contact. Further, this connector is configured such that, when the pressing member is rotated in the other direction, the press-contact between the contact and the flexible circuit is released, so as to enable the flexible circuit to be inserted and extracted into and from the connector main body.

However, the above-described connector is configured such that the contact of the terminal is brought into contact with the flexible circuit only at one place in the insertion/extraction direction of the flexible circuit. Therefore, for example, when foreign matter adheres to the flexible circuit, and when the foreign matter enters between the contact and the flexible circuit, the conductive state between the contact and the flexible circuit is changed to a non-conductive state by the foreign matter, which results in a problem that the connection therebetween fails.

To cope with this problem, a connector has been proposed which uses a terminal having two contacts that are brought into contact with the flexible circuit at two contact positions different from each other in the insertion/extraction direction of the flexible circuit, and in which, even when foreign matter enters between the flexible circuit and one of the contacts, the conductive state between the terminal and the flexible circuit is secured by the other of the contacts, so that the connection failure can be prevented (see, for example, Patent Literature 2).

CITATION LIST

Patent Literature

Patent Literature 1: Japanese Patent 2892945
Patent Literature 2: Japanese Patent 4568791

SUMMARY OF INVENTION

Technical Problem

However, since the flexible circuit is flexible in the thickness direction thereof, the connector has a problem that, in the case where the two contacts are brought into press-contact with the flexible circuit at intervals between the two contacts in the insertion/extraction direction of the flexible circuit, when an intermediate point between the first and second contacts is pressed by the pressing member, the flexible circuit is deflected and thereby the contact pressure at each of the contacts becomes insufficient. Further, in the connector, when the pressing surface of the pressing member is formed in a flat shape so as to bring the flexible circuit into press-contact with both the first and second contacts, the rotation radius of the pressing member needs to be increased in order that the pressing surface of the pressing member is smoothly brought into contact with the flexible circuit while the pressing member is rotated. This results in a problem that the size of the pressing member is increased in correspondence with the increase in the rotation radius.

The present invention has been made in view of the above described problems. An object of the present invention is to provide a connector which can suppress deflection of a connection object without increasing the size of a pressing member, even when two contacts are brought into contact with the connection object at positions different from each other in the insertion/extraction direction of the connection object.

Solution to Problem

In order to achieve the above described object, a connector according to the present invention includes a connector main body enabling a flexible flat connection object to be inserted therein, first and second contacts configured to be brought into contact with one thickness direction surface of the connection object, and a pressing member configured to be rotated in a predetermined rotation direction to thereby bring the connection object to be press-contact with the first and second contacts, and is formed such that the contact positions between the connection object and the first and second contacts are different from each other in the insertion/extraction direction of the connection object. The connector according to the present invention is formed by including a pressing plate which is provided to be positioned on the side of the other thickness direction surface of the connection object, and which, when the pressing member is rotated in the rotation direction, is brought into surface contact with the other thickness direction surface of the connection object while being pressed by the pressing member, and thereby brings the one thickness direction surface of the connection object into press-contact with the first and second contacts, and is formed so that the pressing plate is configured to press at least a range including the contact positions between the connection object and the first and second contacts from the side of the other thickness direction surface of the connection object.

Thereby, when the pressing member is rotated in the predetermined rotation direction, the pressing plate is brought into surface contact with the other thickness direction surface of the connection object while being pressed by the pressing member. Thereby, the range including the contact positions between the connection object and the first and second contacts is pressed via the pressing plate from the side of the other thickness direction surface of the connection object, so that the one thickness direction surface of the connection object is brought into press-contact with the first and second contacts. As a result, the deflection of the connection object is suppressed by the pressing plate without increasing the size of the pressing member.

Advantageous Effects of Invention

The present invention has an advantage that, since even when first and second contacts are brought into contact with a connection object at positions different from each other in the insertion/extraction direction of the connection object, the deflection of the connection object can be suppressed, the contact pressure between the connection object and the first and second contacts can be sufficiently secured, and also the increase in the size of the pressing member is prevented.

DESCRIPTION OF EMBODIMENTS

Figure 1:
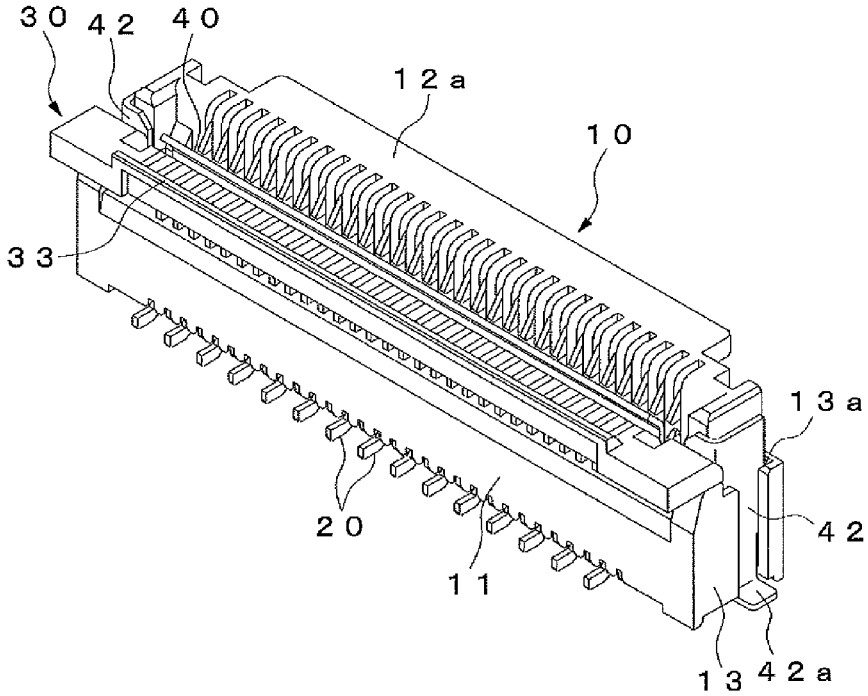
FIG. 1 is a perspective view of an opened state of a connector showing an embodiment of the present invention.
Figure 2:
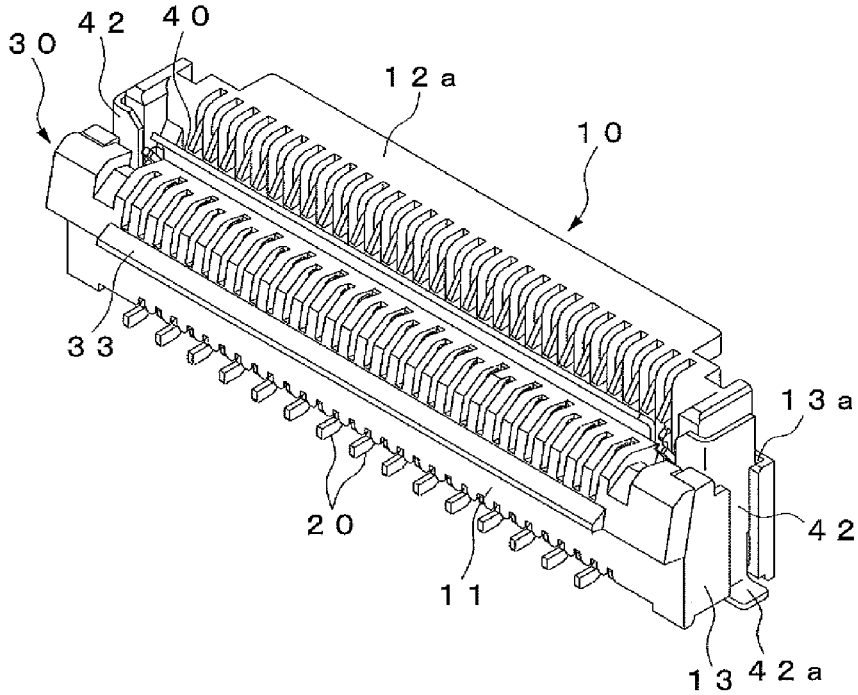
FIG. 2 is a perspective view of a closed state of the connector.
Figure 3:
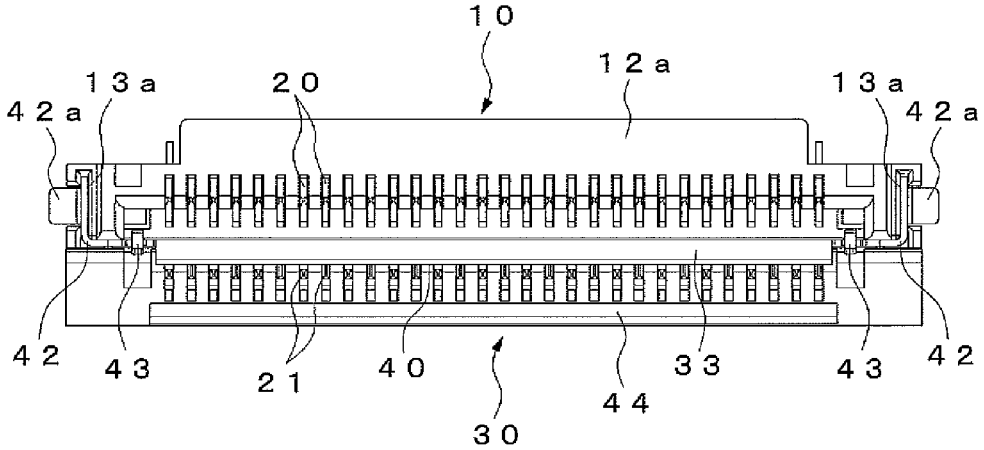
FIG. 3 is a plan view of the connector.
Figure 4:
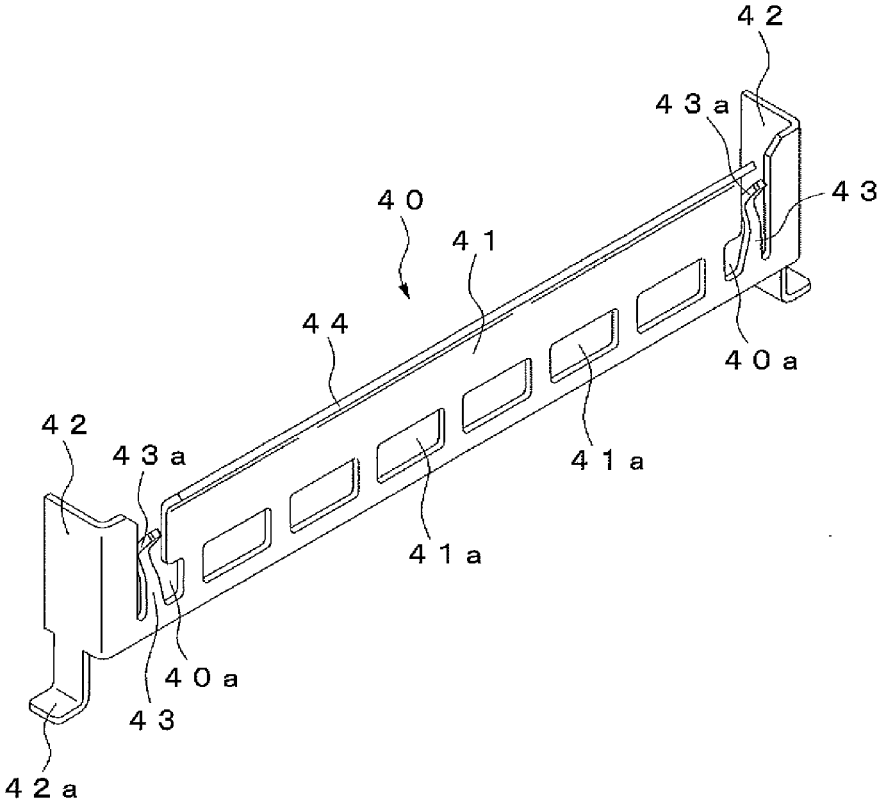
FIG. 4 is a perspective view of a pressing plate.
Figure 5:
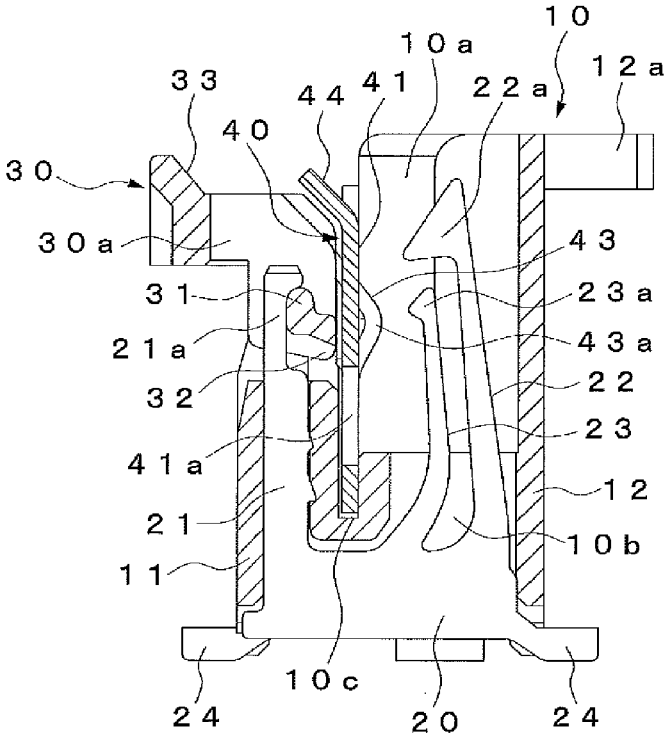
FIG. 5 is a side sectional view of the opened state of the connector.
Figure 6:
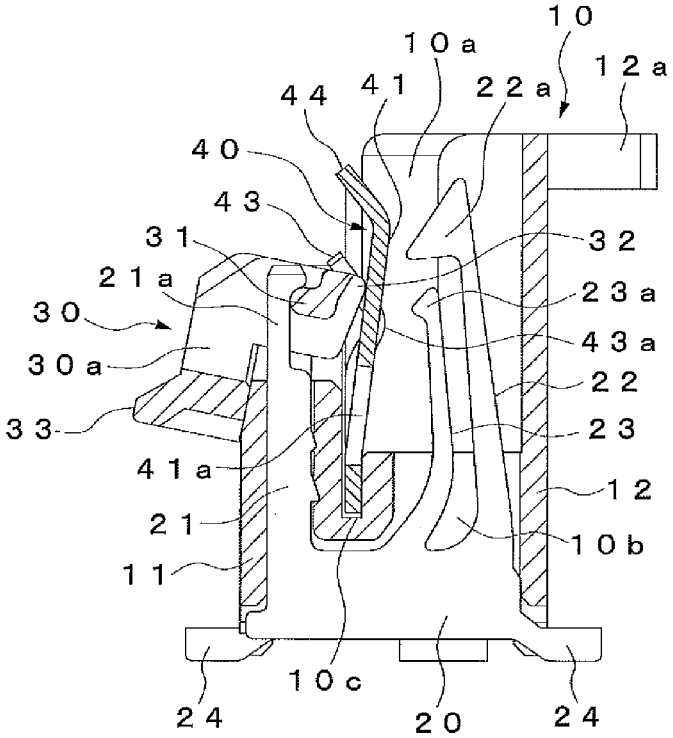
FIG. 6 is a side sectional view of the closed state of the connector.

FIG. 1 to FIG. 9 show an embodiment of the present invention, and show a connector for connecting, for example, an FFC or an FPC to a substrate.

The connector is configured by a connector main body 10 into which one end side of a flexible circuit 1 as a connection object is inserted, a plurality of terminals 20 which are arranged in the connector main body 10 at equal intervals in the width direction of the connector main body 10, a pressing member 30 which is configured to be rotatable to bring the flexible circuit 1 into press-contact with each of the terminals 20, and a pressing plate 40 which presses the flexible circuit 1 to the side of each of the terminals 20 by the pressing force of the pressing member 30.

The flexible circuit 1 is a flat connection object which is flexible in the thickness direction thereof, and is configured by a so-called flexible flat cable (FFC) or a flexible printed circuit (FPC). Further, on one thickness direction surface of the flexible circuit 1, a plurality of electrical contacts (not shown) are provided at intervals therebetween in the width direction of the flexible circuit 1.

The connector main body 10 is made of a synthetic resin molding, and an opening portion 10*a*, into which the flexible circuit 1 is inserted, is provided in the upper surface of the connector main body 10. The connector main body 10 is configured by a front surface portion 11, a rear surface portion 12, and side surface portions 13. On the bottom surface side of the connector main body 10, a plurality of terminal holes 10*b* for respectively holding the terminals 20 are provided at equal intervals therebetween in the width direction of the connector main body 10. Further, a laterally long groove 10*c*, into which the lower end side of the pressing plate 40 is inserted, is provided in the connector main body 10. Also, grooves 13*a*, into which both width-direction sides of the pressing plate 40 are respectively press-fitted, are provided in each of the side surface portions 13 of the connector main body 10, respectively. Further, a projecting portion 12*a* extending toward the rear side is provided at the upper end of the rear surface portion 12 of the connector main body 10.

Each of the terminals 20 is made of a conductive metal plate, and is held by being press-fitted into each of the terminal holes 10*b* of the connector main body 10 from the bottom surface side. A fixed piece portion 21 extending upward is provided on the front end side of each of the terminals 20 and is press-fitted into the front end side of the terminal hole 10*b* of the connector main body 10. A rotation supporting portion 21*a*, which rotatably supports the pressing member 30, is provided on the upper end side of the fixed piece portion 21 and is formed in a concave shape so as to be engaged with the pressing member 30 from the rear side. First and second contacts 22 and 23 extending upward in a two-forked shape are provided at intervals in the front and rear direction on the rear end side of each of the terminals 20. Each of the contacts 22 and 23 is formed so as to be elastically deformable in the front and rear direction, respectively. The first contact 22 is arranged on the rear side of the second contact 23 and is formed to have a height larger than the height of the second contact 23. Each of contact portions 22*a* and 23*a*, which are respectively brought into contact with electrical contacts (not shown) provided on one thickness direction surface of the flexible circuit 1, is provided at the upper end of each of the contacts 22 and 23, respectively. Each of the contact portions 22*a* and 23*a* is formed so as to project forward in a mountain shape. In this case, the contact portion 22*a* of the first contact 22 is arranged above the contact portion 23*a* of the second contact 23. The contact point between the contact portion 22*a* of the first contact 22 and the flexible circuit 1 is positioned slightly forward (on the side of the flexible circuit 1) from the contact point between the contact portion 23*a* of the second contact 23 and the flexible circuit 1. Further, a board connecting portion 24 to be connected to a substrate (not shown) is provided at the lower end of each of the terminals 20.

The pressing member 30 is made of a synthetic resin molding and is provided so as to cover a portion ranging from the upper surface front end side to the front surface upper end side of the connector main body 10. A plurality of insertion holes 30*a*, into each of which the rotation supporting portion 21*a* of each of the terminals 20 is inserted, are provided in the pressing member 30 at equal intervals therebetween in the width direction of the connector main body 10. A rotary shaft portion 31, which engages with the rotation supporting portion 21*a*, is provided in each of the insertion holes 30*a*. A pressing portion 32, which presses the pressing plate 40 toward the rear side, is provided at one end of the pressing member 30. The pressing portion 32 is arranged between the fixed piece portion 21 and the contacts 22 and 23 of each of the terminals 20. In this case, when the pressing member 30 is positioned at an opened position (a position at which the upper surface of the pressing member 30 is in parallel with the horizontal direction), the pressing portion 32 is positioned slightly forward from the pressing plate 40.

When the pressing member 30 is rotated toward a closed position (a position at which the upper surface of the pressing member 30 forms an angle of about 75° with respect to the horizontal direction), the pressing member 30 is made to project toward the rear side so as to press the pressing plate 40 toward the rear side. In this case, when the pressing member 30 is rotated to the closed position, the pressing portion 32 is positioned at a vertically substantially central portion between the contact portion 22*a* of the first contact 22 and the contact portion 23*a* of the second contact 23. An operation portion 33 is provided at the upper end of the pressing member 30.

The pressing plate 40 is formed by bending a metal plate and is arranged in the connector main body 10 so as to be positioned between the fixed piece portion 21 and the respective contacts 22 and 23 of each of the terminals 20. The pressing plate 40 is integrally formed by a plate-like movable piece portion 41 which is elastically deformed by the pressing force of the pressing member 30, a pair of fixing portions 42 fixed to the connector main body 10, a pair of temporary holding portions 43 which temporarily hold the flexible circuit 1 inserted into the connector main body 10, and a guide portion 44 which guides the flexible circuit 1. A cutout portion 40*a*, the upper end of which is opened, is provided between the movable piece portion 41 and both width-direction end portions of the pressing plate 40.

The movable piece portion 41 is provided between each of the cutout portions 40*a*, and is formed laterally long so as to extend over all the terminals 20.

The lower end side of the movable piece portion 41 is inserted into the terminal hole 10*b*formed in the connector main body 10. A plurality of holes 41*a* penetrating the movable piece portion 41 in the thickness direction thereof are provided in the lower portion of the movable piece portion 41 and are arranged at intervals therebetween in the width direction of the movable piece portion 41. Thereby, the movable piece portion 41 is configured such that the rigidity of the lower portion in which the respective holes 41*a* are provided is lower than the rigidity of the upper portion in which the respective holes 41*a* are not provided. Therefore, when the upper portion of the movable piece portion 41 is pressed by the pressing member 30, the lower portion (the part between the respective holes 41*a*) of the movable piece portion 41 is elastically deformed so that the upper portion of the movable piece portion 41 is displaced toward the rear side. In this case, the upper portion of the movable piece portion 41 is formed so that a range including the contact positions between the flexible circuit 1 and the contact portions 22*a* and 23*a* of the first and second contacts 22 and 23 can be pressed from the other thickness direction surface of the flexible circuit 1.

Each of the fixing portions 42 is provided at both width-direction end portions of the pressing plate 40 which are respectively separated from the movable piece portion 41 by the cutout portions 40*a*, and is bent in an L-shape toward the rear side, respectively. Each of the fixing portions 42 is fixed to the connector main body 10 by being press-fitted into each of the grooves 13*a* of the connector main body 10, respectively. Further, a board connecting portion 42*a* to be connected to a respective substrate (not shown) is provided at the lower end of each of the fixing portions 42.

Each of the temporary holding portions 43 is provided in each of the cutout portions 40*a* and is formed so as to extend upward from the lower end of the cutout portion 40*a*. The temporary holding portion 43 is formed to be elastically deformable in the front and rear direction, and a mountain-shaped locking portion 43*a*, which locks the flexible circuit 1, is projectingly provided at the upper end side of the temporary holding portion 43.

The guide portion 44 is provided at the upper end of the movable piece portion 41 and is formed so as to incline forward and obliquely upward.

Figure 7:
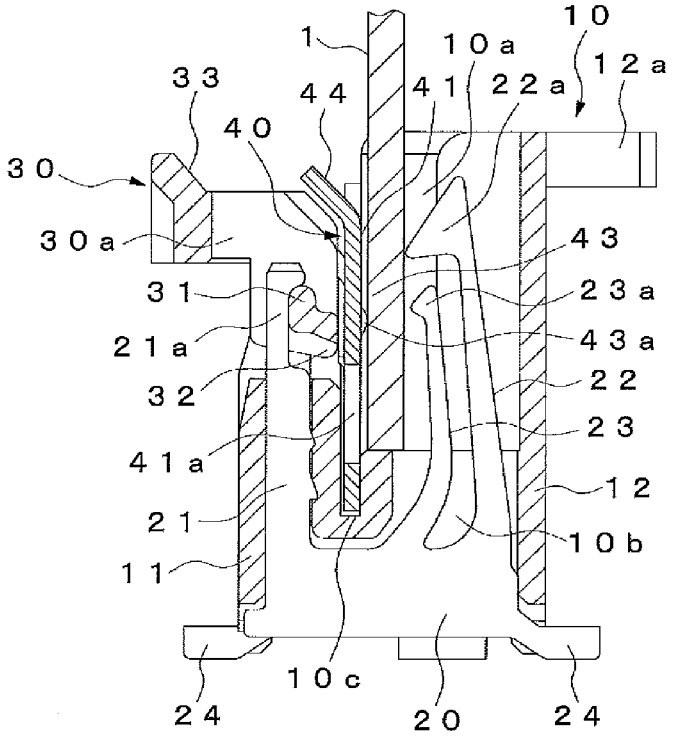
FIG. 7 is a side sectional view of the opened state of the connector into which a flexible circuit is inserted.

When the flexible circuit 1 is connected to the connector configured as described above, the pressing member 30 is first set at the opened position as shown in FIG. 7, and the flexible circuit 1 is inserted into the opening portion 10*a* of the connector main body 10 from above. In this case, the flexible circuit 1 is guided into the connector main body 10 by the inclined surface of the guide portion 44 of the pressing plate 40. Further, when the flexible circuit 1 is inserted into the connector main body 10, the flexible circuit 1 is locked in such a manner that each of the locking portions 43*a* of the temporary holding portions 43 is brought into press-contact with both width direction ends of the other thickness direction surface of the flexible circuit 1. Thereby, the flexible circuit 1 is temporarily held on the side of the connector main body 10 by each of the temporary holding portions 43.

Figure 8:
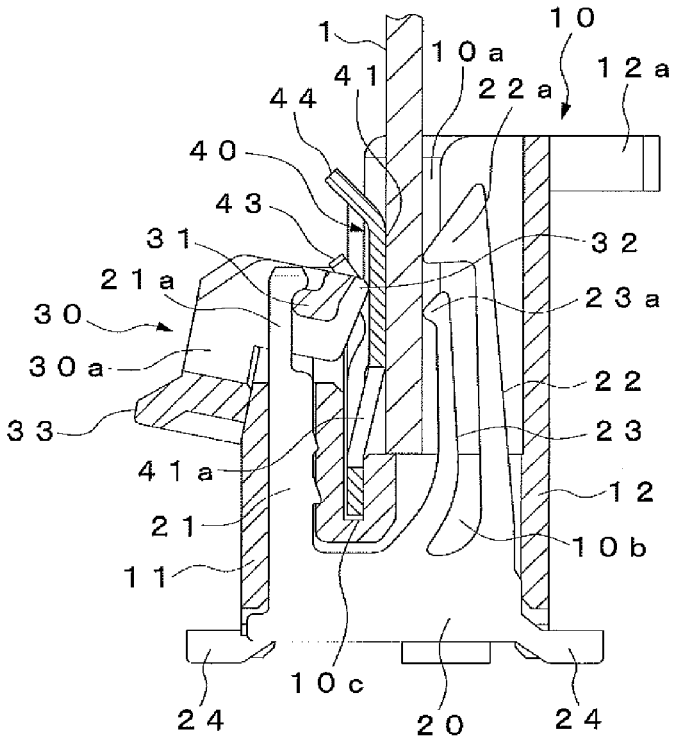
FIG. 8 is a side sectional view of the closed state of the connector into which the flexible circuit is inserted.
Figure 9:
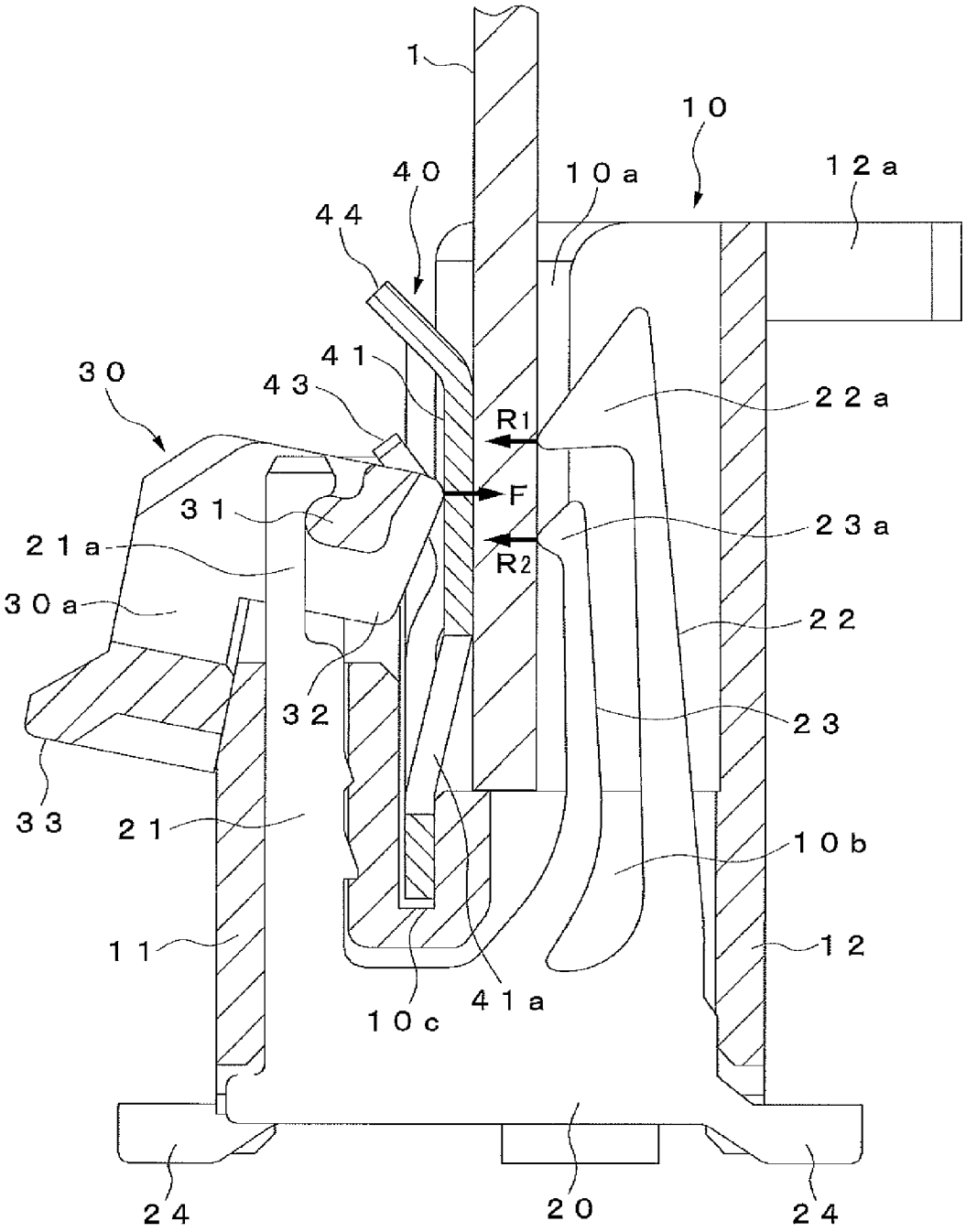
FIG. 9 is an enlarged side sectional view of the closed state of the connector into which the flexible circuit is inserted.

Next, as shown in FIG. 8, when the operation portion 33 of the pressing member 30 is press-operated in the downward direction, and thereby when the pressing member 30 is rotated to the closed position, the flexible circuit 1 is brought into press-contact with each of the terminals 20, so that the flexible circuit 1 is connected to the terminals 20. In this case, when the pressing member 30 is rotated to the closing direction, the pressing portion 32 of the pressing member 30 is rotated about the rotary shaft portion 31 while being supported by the rotation supporting portion 21*a*, so that the movable piece portion 41 of the pressing plate 40 is pressed by the pressing portion 32 to the side of the flexible circuit 1. Thereby, the movable piece portion 41 is displaced toward the rear side so as to press the flexible circuit 1, so that the one thickness direction surface of the flexible circuit 1 is brought into press-contact with the contact portions 22*a* and 23*a* of the first and second contacts 22 and 23 of each of the terminals 20. In this case, when the upper portion of the movable piece portion 41 of the pressing plate 40 is pressed by the pressing member 30, the lower portion of the movable piece portion 41 is elastically deformed, so that the upper portion of the movable piece portion 41 is displaced to the rear side while the upper portion of the movable piece portion 41 is maintained in the planar state. Thereby, while the movable piece portion 41 is brought into surface contact with the other thickness direction surface of the flexible circuit 1, the movable piece portion 41 presses the range including the contact positions between the flexible circuit 1 and the contact portions 22*a* and 23*a* of the first and second contacts 22 and 23. Therefore, the flexible circuit 1 is pressed by the pressing member 30 via the movable piece portion 41 of the pressing plate 40, which portion has a rigidity higher than the rigidity of the flexible circuit 1 in the thickness direction of the flexible circuit 1, and hence the deflection of the flexible circuit 1 is suppressed. Further, the movable piece portion 41 is pressed by the pressing portion 32 at a substantially central portion in a vertical direction between the contact portion 22*a* of the first contact 22 and the contact portion 23*a* of the second contact 23. Therefore, as shown in FIG. 9, the reaction force R1 of the first contact 22 and the reaction force R2 of the second contact 23 against the pressing force F of the pressing portion 32 are substantially equally applied to the flexible circuit 1.

With the present embodiment, each of the terminals 20 can be brought into contact with the flexible circuit 1 at two points by the first and second contacts 22 and 23. Therefore, even when foreign matter enters between the flexible circuit 1 and one of the contacts 22 and 23, the conductive state between the terminal 20 and the flexible circuit 1 can be secured by the other of the contacts 22 and 23, and hence it is possible to efficiently prevent the occurrence of connection failure.

In this case, when the pressing member 30 is rotated to the closed position, the pressing plate 40 is brought into surface contact with the other thickness direction surface of the flexible circuit 1 while being pressed by the pressing portion 32 of the pressing member 30. Thereby, the range including the contact positions between the flexible circuit 1 and the first and second contacts 22 and 23 is pressed from the side of the other thickness direction surface of the flexible circuit 1 via the pressing plate 40, so that the one thickness direction surface of the flexible circuit 1 is brought into press-contact with first and second contacts 22 and 23. As a result, the deflection of the flexible circuit 1 can be suppressed by the pressing plate 40, and the contact pressure of the first and second contacts 22 and 23 with respect to the flexible circuit 1 can be sufficiently secured. In this case, it is not necessary that the rotation radius of the pressing member 30 is increased as in the case where the pressing member itself is brought into surface-contact with the flexible circuit 1, and hence there is also an advantage that the size of the pressing member 30 needs not be increased.

Further, the pressing plate 40 is configured to be provided with the movable piece portion 41 which is elastically deformed by the pressing force of the pressing member 30, and is configured such that, when the lower portion of the movable piece portion 41 is elastically deformed, the upper portion of the movable piece portion 41 is brought into surface contact with the flexible circuit 1. Thereby, while the upper portion of the movable piece portion 41 is maintained in the planar state, the movable piece portion 41 can be easily elastically deformed, so that the movable piece portion 41 can be surely brought into surface contact with the flexible circuit 1.

In this case, a plurality of the holes 41*a* are provided in the lower portion of the movable piece portion 41, and thereby the lower portion of the movable piece portion 41 is formed to have a rigidity smaller than the rigidity of the upper portion of the movable piece portion 41. Therefore, the restoring force applied to the pressing portion 32 of the pressing member 30 by the movable piece portion 41 can be reduced, and hence the pressing member 30 can be smoothly rotated.

Further, it is configured such that, when the pressing member 30 is rotated to the closed position, the position at which the pressing plate 40 is pressed by the pressing portion 32 is positioned between the contact position of the contact portion 22*a* of the first contact 22 with the flexible circuit 1, and the contact position of the contact portion 23*a* of the second contact 23 with the flexible circuit 1. Thereby, the reaction force R1 of the first contact 22 and the reaction force R2 of the second contact 23 against the pressing force F of the pressing portion 32 are substantially equally applied to the flexible circuit 1. Therefore, the conductive state between the flexible circuit 1 and each of the contacts 22 and 23 can always be maintained in a good state.

Further, it is configured such that the flexible circuit 1, which is inserted into the connector main body 10, is guided into the connector main body 10 by the guide portion 44, and hence the insertion operation of the flexible circuit 1 can be easily and surely performed. In this case, since the guide portion 44 is provided integrally with the pressing plate 40, it is not necessary to provide separately a member for guiding the flexible circuit 1 into the connector main body 10, and hence the structure can be simplified.

Further, the flexible circuit 1 inserted into the connector main body 10 is locked by the temporary holding portion 43 of the pressing plate 40, and thereby is temporarily held on the connector main body 10 side.

Therefore, even before the pressing member 30 is rotated to the closed position, the positional deviation and the coming-off of the flexible circuit 1 can be prevented, and hence the connection operation of the flexible circuit 1 can be surely performed.

Note that the above-described embodiment is shown to have a configuration in which the pressing plate 40 fixed to the connector main body 10 is elastically deformed by being pressed by the pressing member 30. However, the above-described embodiment may also be configured such that the pressing plate not fixed to the connector main body 10 is provided so as to be movable in the pressing direction of the pressing member 30.

Note that the above-described embodiment is shown to have a configuration in which the first contact 22 and the second contact 23 are provided integrally with the terminal 20. However, the above-described embodiment may also be configured such that the first and second contacts may be respectively provided at separate terminals.

REFERENCE SIGNS LIST

1 Flexible circuit
10 Connector main body
20 Terminal
22 First contact
22*a* Contact portion
23 Second contact
23*a* Contact portion
30 Pressing member
32 Pressing portion
40 Pressing plate
41 Movable piece portion
43 Temporary holding portion
44 Guide portion.

The invention claimed is:

1. A connector comprising:

a connector main body enabling a flexible flat connection object to be inserted therein, the connection object having two surfaces opposing each other in a thickness direction of the connection object, first and second contacts configured to be brought into contact with one of the two surfaces of the connection object, a pressing member configured to bring the connection object into press-contact with the first and second contacts by being rotated in a predetermined rotation direction, such that contact positions between the connection object and the first and second contacts are different from each other in an insertion/extraction direction of the connection object, a pressing plate which is provided to be positioned on a side of the other of the two surfaces of the connection object, wherein, when the pressing member is rotated in the rotation direction, the pressing plate is brought into surface contact with the other surface of the connection object while being pressed by the pressing member, and thereby brings the surface of the connection object into press-contact with the first and second contacts, and wherein the pressing plate is formed to press at least a range including the contact positions between the connection object and the first and second contacts from the side of the other surface of the connection object.

2. The connector according to claim 1, wherein the pressing plate is provided with a movable piece portion which is elastically deformed by being pressed by the pressing member, and the movable piece portion is formed such that a part of the movable piece portion is elastically deformed relative to the other part of the movable piece portion and thereby the other part is brought into surface contact with the connection object.

3. The connector according to claim 2, wherein the part of the movable piece portion is formed to have a rigidity lower than the rigidity of the other part of the movable piece portion.

4. The connector according to claim 1, wherein the pressing member is formed such that, when the pressing member is rotated to a predetermined position in the rotation direction, the pressing position at which the pressing plate is pressed by the pressing member is positioned between the contact position of the first contact with the connection object, and the contact position of the second contact with the connection object.

5. The connector according to claim 1, wherein the pressing plate is provided with a guide portion which guides, into the connector main body, the connection object to be inserted into the connector main body.

6. The connector according to claim 1, wherein the pressing plate is provided with a temporary holding portion which locks the connection object to be inserted into the connector main body and thereby enables the connection object to be temporarily held on the connector main body side.

* * * * *